United States Patent [19]

Charlton

[11] Patent Number: 4,797,970

[45] Date of Patent: Jan. 17, 1989

[54] FOOT-OPERATED DOOR SECURITY DEVICE

[76] Inventor: John C. Charlton, 581 Middleside Road, Rte. 3,, Amherstburg, Ontario, Canada, N9V 3R3

[21] Appl. No.: 158,561

[22] Filed: Feb. 22, 1988

[51] Int. Cl.[4] ..... E05F 5/00

[52] U.S. Cl. ..... 16/82; 16/85; 16/DIG. 10; 16/DIG. 17; 16/86 A; 292/DIG. 15

[58] Field of Search ..... 16/82, 85, 86 R, 86 A, 16/86 B, 86 C, DIG. 10, DIG. 17; 292/DIG. 4, DIG. 15, 338, 342

[56] References Cited

U.S. PATENT DOCUMENTS

| | | | |
|---|---|---|---|
| 3,805,322 | 4/1974 | Serrano | 16/82 |
| 3,833,963 | 9/1974 | Waters | 16/82 |
| 4,216,986 | 8/1980 | McNinch et al. | 16/82 |
| 4,303,266 | 12/1981 | Volpi | 292/DIG. 15 |
| 4,462,623 | 9/1982 | Grant | 292/175 |
| 4,501,444 | 2/1985 | Dominquez | 292/342 |
| 4,570,984 | 2/1986 | Russ | 292/18 |
| 4,601,502 | 7/1986 | Van Dyke | 292/252 |
| 4,601,504 | 7/1986 | Wolf | 292/334 |
| 4,631,776 | 12/1986 | King | 16/82 |

FOREIGN PATENT DOCUMENTS

| | | | |
|---|---|---|---|
| 888220 | 8/1953 | Fed. Rep. of Germany | 16/82 |

*Primary Examiner*—Nicholas P. Godici
*Assistant Examiner*—Edward A. Brown
*Attorney, Agent, or Firm*—Cullen, Sloman, Cantor, Grauer, Scott & Rutherford

[57] ABSTRACT

A door security device which is mounted in the floor or other flat surface in the arc of passage of a door which can be operated solely by one's foot. The door security device includes a housing with a flange plate which is mounted in the opening of the floor surface. A stop member is provided within the housing which assumes two alternate positions, a lowered position and a raised position. In the lowered position, the door is free to move through its arc of passage without obstruction by the door security device. By pressing down on the principal surface of the stop member, a latching mechanism is actuated which allows the stop member to be spring biased into the open position. In the open position the stop member obstructs the motion of the door through its arc of passage so that the door can be opened only a limited distance. To lower the stop member, one simply pushes down on the raised stop member a distance sufficient to actuate the pressure responsive latch mechanism that engages and holds the stop member in the lowered position. The door security device is principally spring actuated and is preferably constructed of metal to provide good endurance and strength characteristics.

14 Claims, 2 Drawing Sheets

39
26
34
20
41
38
36
24
34
48
43
42
45
30
132
48
36
72
28
43
32
78
54
56
22

54
20
82
58
50
106
52
68
62
72
3
66
3
76
104
70
60
108
80
51
74
53

44
6
112
64
51
58
54
53
60
42
110
98
2
90
A
2
41
72
88
68
40
96
62
94
7
7
92
93
66
97
108
74
76
80
84
120
122
118
124
126
6

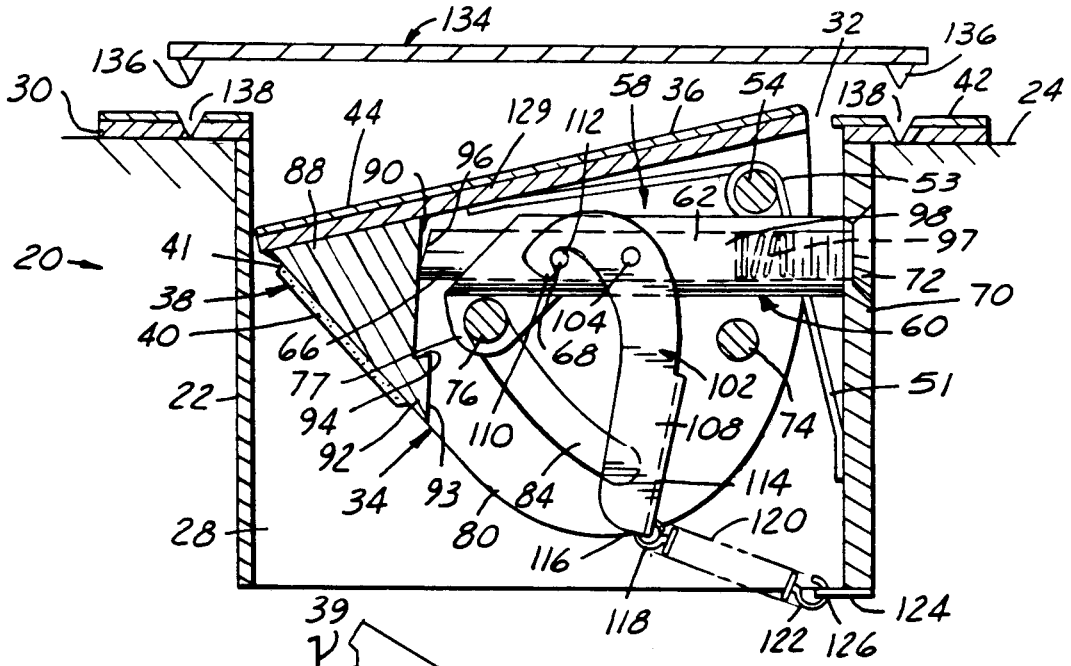
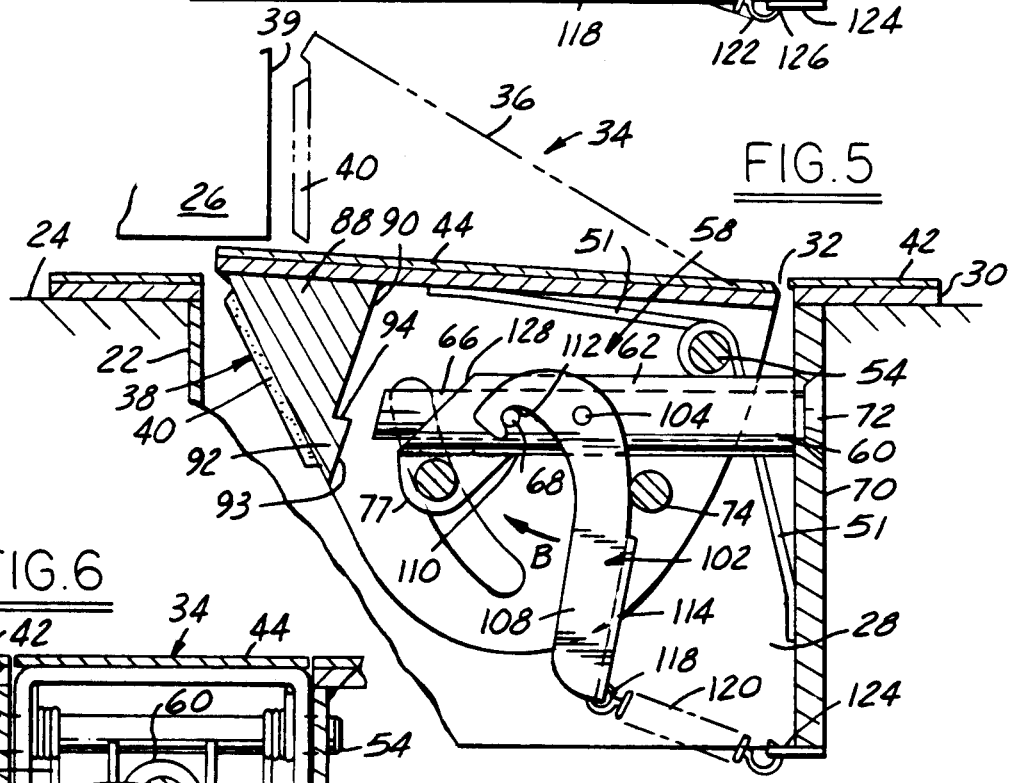
FIG.5
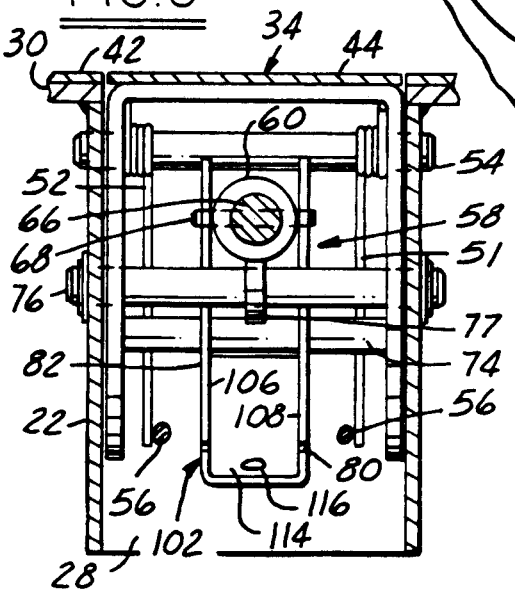
FIG.6
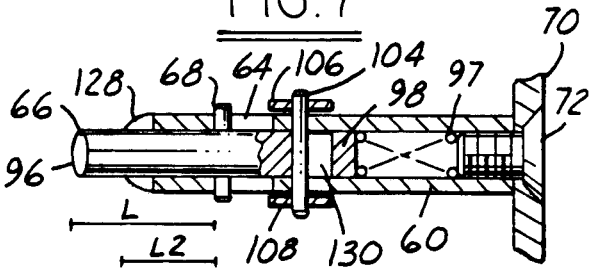
FIG.7

FOOT-OPERATED DOOR SECURITY DEVICE

FIELD OF THE INVENTION

The present invention relates generally to devices which are commonly referred to as door stops and to building security devices. More specifically, the present invention relates to a foot-actuated security device having a retractable security stop member.

BACKGROUND OF THE INVENTION

The Uniform Criminal Reporting Program of the U.S. Department of Justice defines burglary as the unlawful entry of a structure to commit a felony or theft. Burglary is generally categorized into three subclassifications: forcible entry, unlawful entry where no force is used and attempted forcible entry. In 1985 the number of burglaries in the U.S. was estimated at over three million separate offenses. In 1986, this figure had increased a startling 5.5 percent reflecting a rate of 1,344 offenses per hundred thousand inhabitants. Thus, burglaries account for 25 percent of all crime index offenses.

Two out of every three burglaries are residential in nature. Seventy percent of all burglaries involve forcible entry. Burglary victims suffered a combined loss in 1986 of approximately three billion dollars, with the average loss per burglary set at almost a thousand dollars.

In order to protect life and property, a number of anti-burglary devices have been developed by others in the past. These include alarms and silent intrusion detection devices which are devised to alert building occupants of an unauthorized entry into the premises. However, alarms do little to protect against forcible entry, although they may occasionally thwart a burglary by frightening an intruder.

A more practical method of preventing unwanted intrusion by a burglar is to provide intrusion-resistant premises. This is commonly achieved to varying degrees of success by conventional locks such as dead bolt assemblies in doors and windows. Other devices such as "charley bars" have provided some additional fortification of doors, although there usefulness is limited and they are generally inconvenient to implement.

Of particular concern are those intruders that gain entry by first knocking or ringing a door bell, only to force themselves into the premises when the lawful occupant unlocks the door to determine who is calling. To prevent such entry, door "peepholes" which may include wide angle lenses or the like have been provided to allow an occupant to visually inspect and verify the identity of the caller. Unfortunately, doors which are solid enough to withstand attempted forceful entry are often insulative to sound which makes it difficult to interrogate an unrecognized intruder to determine the nature of the call. To this end, security chains have been developed by which a limited clearance or opening of the door can be achieved while still maintaining some protection against entry.

Security chains commonly include means for mounting one end of the chain to a molding which circumscribes the door frame and a second mounting means having a slot or channel which is secured directly to the door. A member attached to the free end of the chain is adapted to be closely and securely received by the door mounting means. Thus, when one wishes to speak to a suspect caller, one merely secures the free end of the chain to the door mount and unlocks the door. The door can then be opened a distance regulated by the length of the security chain.

As law enforcement personnel know all to well, the fallacy of security chains is that they are inherently structurally weak. Very little force is necessary to break the links of a typical security chain due to their low tensile strength. Moreover, even an intruder of moderate build can very often ram a door with a sufficient force to pull the chain mounting means from their moorings, at times separating the door frame molding from underlying structures. Therefore, security chains are many times inadequate to prevent intrusion and may in fact give an occupant a false and fatal sense of security where none exists.

A solution to the problems inherent in security chains, one which still permits a door to be opened slightly to interrogate a caller, is the provision of a door stop member mounted directly to the floor of a room within the arc of passage of the door as it swings upon its hinges. In use, a door stop member is mounted on a floor bracket which is adapted to rigidly receive the stop member. One such device is disclosed in U.S. Pat. No. 3,833,963 to Waters. There, a door stop comprising a channeled floor plate and a stop member is disclosed. The plate is mounted in the floor surface such that the floor surface and the top of the plate lie in the same plane. In this mode the door is free to swing through its complete arc of passage. When the movement of the door is to be impeded, a separate component, the stop member, is inserted into the floor mount via its channels where it is then locked into place. While the concept is viable, the device is impractical due to its inconvenient method of operation.

Although appropriate as stop members, the devices disclosed in U.S. Pat. No. 4,601,502 to Van Dyke, U.S. Pat. No. 4,601,504 to Wolf and U.S. Pat. No. 4,462,623 to Grant all suffer from numerous drawbacks including their limited ability to withstand the substantial lateral forces which would be exerted on their stop rods or pins. Not only would the stop rods most likely bend if not formed of strengthened materials, their delicate and complicated spring actuating mechanisms may be irreparably damaged in response to any significant force. Moreover, it is clear that in order to be operated conveniently with one's foot, the cross-sectional area of the telescopic rods would have to be extremely large. For these and other reasons, these pin-like devices are wholely impractical as sturdy door security devices.

A more realistic approach is disclosed in U.S. Pat. No. 3,805,322 to Serrano. There, unlike the aforementioned devices, a pivotable stop member is provided in a housing which is mounted in a floor cavity. In one mode of operation, the device is retracted within the floor cavity and in the second mode of operation, the pivotable stop member is raised above the floor surface to engage and thus stop the arcuate movement of the door. It is stated in Serrano that the device can be operated with one's foot. However, from close inspection, it is apparent that although it is possible to raise the stop member by the complicated process of turning a floor mounted serrated disc with one's foot, it is virtually impossible to lower the stop member without reaching down to the floor with one's hand to release a support strut or finger. In fact, once the strut is released it is still necessary to once again turn the serrated disc precisely back to its initial position, requiring rotational movement against the opposing force of the biasing member. Further, the thin stop member, its precarious attachment to the housing, and the fragile support strut all combine to create far too many weak links for substantial safety against intrusion.

The present invention overcomes these various deficiencies in the prior art devices by providing a unique, truly foot-operated safety door stop having superior strength of construction, ease of operability, and which is economical and vitually maintenance free.

SUMMARY OF THE INVENTION

In accordance with the present invention there is provided a door security device which includes a housing which is mounted beneath a flat surface such as a floor. The housing is supported by a floor plate or flange which is mounted by screws of the like to the floor surface. A foot-operated stop member alternates between raised and lowered positions in response to a force exerted downward on the stop member by one's foot.

The door security device includes a novel latch mechanism mounted within the housing which is responsive to movement of the stop member by virtue of a camming surface and a catch release rod. The stop member is spring biased in a raised position and is held in the lower position against this biasing force by a spring actuated plunger in sliding relation with a barrel. When the stop member is in the raised position the plunger is held within the barrel by a spring actuated catch mechanism.

The door security device is designed to be placed several inches from a door in the arc of passage. In the lowered position, the door can pass over the door security device without contacting the device. In the raised position, the passage of the door through its normal arc is impeded by contact with a door-engaging surface of the raised stop member.

Thus, the present invention provides simple, economical method of securing a door such that it can be opened only slightly to interrogate a caller and which can be wholely operated with the pressure of one's foot. These and other meritorious features and advantages of the present invention will be more fully described herein in connection with the description of the preferred embodiments and with reference to the drawings in which:

BRIEF DESCRIPTION OF THE DRAWINGS

FIG. 4 is a cross-sectional elevational view of the present invention illustrating the depression of the stop member locking the plunger in position.

FIG. 5 is a cross-sectional elevational view similar to FIG. 4, but illustrating the movement of the stop member from the lowered position to the raised position where the plunger is locked in the barrel.

FIG. 6 is a cross-sectional end view taken along line 6—6 of FIG. 3.

FIG. 7 is a partial cross-section of the plunger/barrel assembly of the present invention taken along line 7—7 of FIG. 3.

DETAILED DESCRIPTION OF THE PREFERRED EMBODIMENTS

Figure 1:
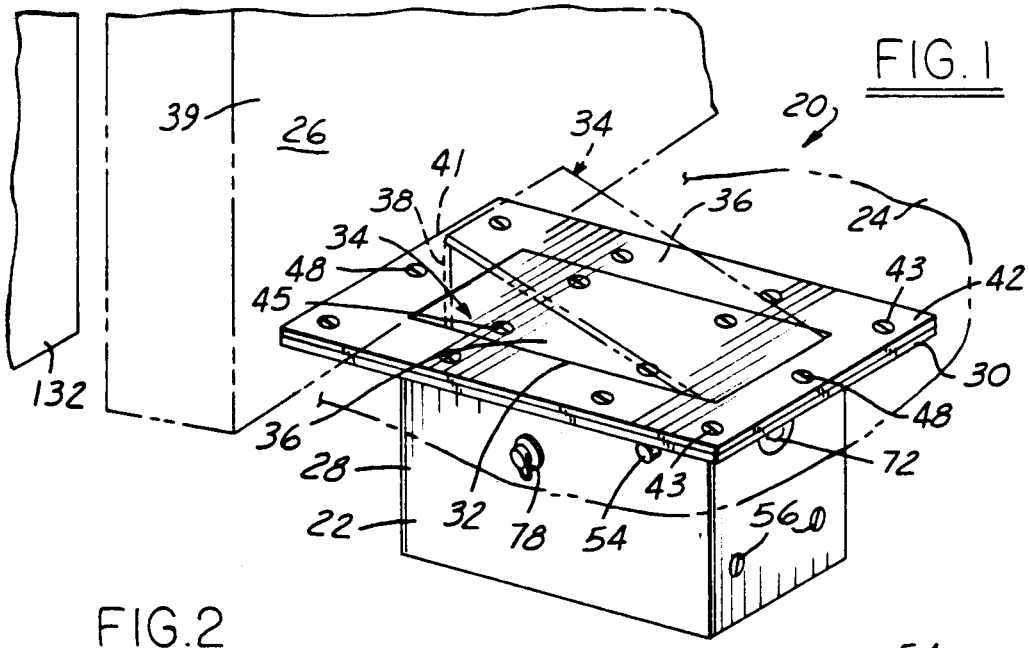
FIG. 1 is a perspective view of the door security device of the present invention with the stop member shown in both the lowered mode and the raised mode, the latter being shown in phantom.

Referring now to the drawings, a preferred embodiment of the present invention will be described. With reference now to FIG. 1, foot-operated or actuated door security device 20 is shown generally which includes housing 22 that extends below floor 24 which is shown broken away for purposes of illustration. One of the advantages of the present invention is that it is mounted relatively flush with the top surface of floor 24 so that door 26 can swing freely through its arc of passage across door security device 20 in one mode of operation. Accordingly, door security device 20 is mounted by inserting housing 22 through a opening in floor 24 having a corresponding shape, here, rectangular. Housing 22 defines a chamber 28 the contents of which will be described more fully herein.

Attached to and supporting housing 22 is floor plate 30 which is in the nature of a mounting flange or the like. Material suitable for forming housing 22 and floor plate 30 are generally inexpensive formable metals such as steel with good strength characteristics and wearability. Other materials having these characteristics may be suitable or even desirable in a particular application.

Floor plate 30 is provided with a rectangular opening 32 which closely receives pivotable stop member 34 in both its retracted position and its raised or projective position, the latter being shown in phantom. Pivotable or retractable stop member 34 includes principal surface 36, again being shown in both the raised and retracted positions. Pivotable stop member 34 is provided with door engaging surface 38. Door engaging surface 38 engages surface 39 of door 26 in one mode of operation. In order to prevent door engaging surface 38 from marring door surface 39, rubber pad 40 is preferably provided which may be formed of any non-marking resilient material. Rubber pad 40 may be attached to stop member 34 in a number of acceptable manners such as by the use of screws or adhesives. Rubber pad 40 is provided with chamfered surface 41 to achieve better clearance as stop member 34 pivots in and out of chamber 28.

To achieve a more finished appearance, cover plate 42 is provided on floor plate 30, secured in position by screws 43. Similarly, principal surface 36 of stop member 34 is provided with cover plate 44 secured by screws 45. Cover plates 42 and 44 preferably comprise brass or some other lustrous material. Mounting screws 48 are provided which extend through cover plate 44 and floor plate 30 by which door security device 20 is mounted in floor 24. The floor opening may be countersunk such that floor plate 30 is attached by mounting screws 48 to a countersunk portion of floor 24, such that cover plates 42 and 44 are precisely flush with the top surface of floor 24 when stop member 34 is in the retracted position, although this is usually not necessary for adequate clearance.

Figure 2:
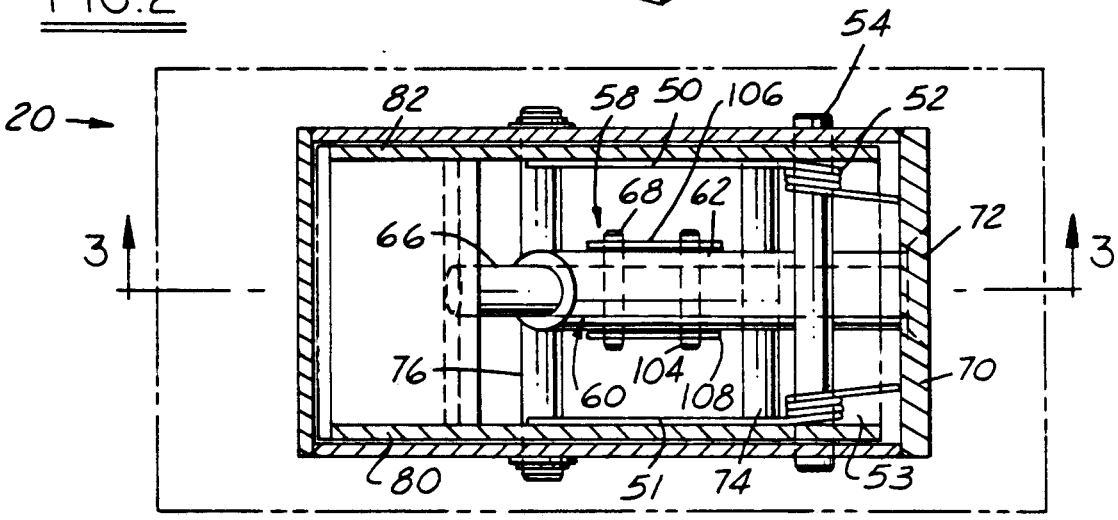
FIG. 2 is a plan view of the door security device of the present invention of a section taken beneath the floor plate.

Referring now to FIG. 2 of the drawings, a plan view section of door security device 20 is shown just below floor plate 30. Stop member springs 50 and 51 are seen having spring loops 52 and 53 which loop around stop member pivot axle or shaft 54. A pair of spring retaining screws 56 shown only in FIG. 1 and FIG. 6 are provided to retain the legs of stop member springs 50 and 51 in position. Pivot axle 54 is preferably stationary with respect to housing 22 and extends through stop member 34 transversely. It is pivot axis 54 which allows stop member 34 to pivot between the raised and lowered positions. Springs 50 and 51 serve to bias stop member 34 in the direction of arrow A in FIG. 3. Hence, as it will be more fully explained, stop member 34 is restrained against this biasing force produced by springs 50 and 51 when stop member 34 is in the retracted position.

Figure 3:
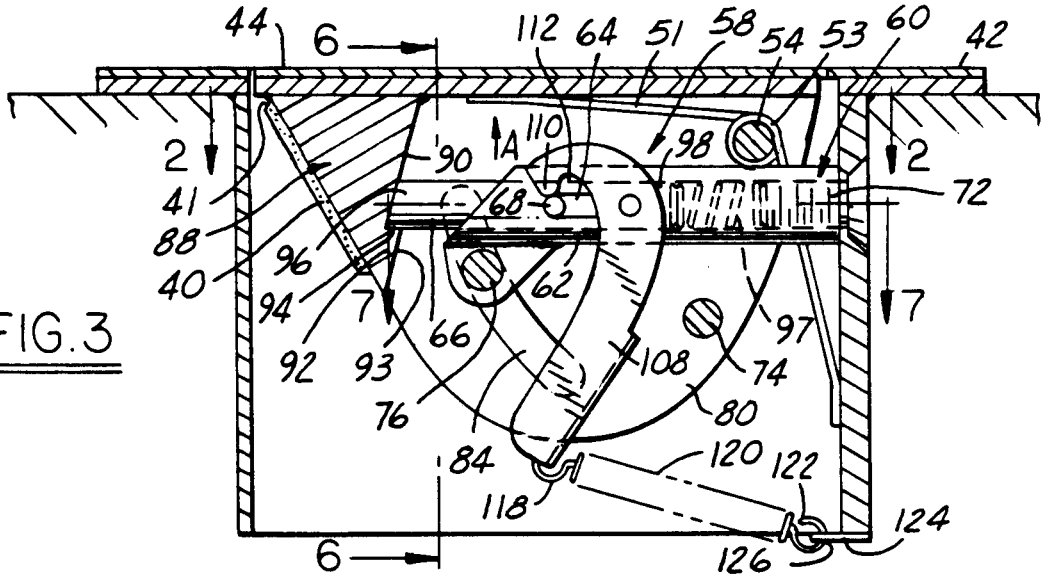
FIG. 3 is a cross-sectional elevational view taken along lines 3—3 of FIG. 2.

Referring now specifically to FIGS. 2 and 3 of the drawings, latch mechanism 58 is shown generally which includes latch barrel 60 having dual slotted wall 62. In other words, wall 62 of latch barrel 60 is provided with slots 64 in an opposed fashion, one of which is shown best in FIG. 3. Closely received within latch barrel 60 is latch rod or plunger 66. Latch barrel 60 and latch plunger 66 are arranged in a piston/cylinder-like configuration. Although the outer surface of plunger 66 is in substantial contact with the inner surface of latch barrel 60, they are in sliding contact so that latch rod 66 can easily move partially in and out of latch barrel 60. Latch rod or plunger 66 is provided with opposed latch rod pins 68 which are shown here as one structure extending through plunger 66. It may be suitable to simply form each pin 68 on the outer surface of plunger 66. Opposed latch rod pins 68 serve as the means by which plunger 66 is retained in one position in barrel 60 during one mode of operation. Barrel 60 is secured to thickened wall 70 of housing 22 with the use of barrel retaining screw 72 shown both in FIGS. 1 and 2. That end of barrel 60 which abuts thickened wall 70 is threaded to receive screw 72. Stop member 34 further includes catch release rod or bar 72 which provides added strength to stop member 22 and which serves as a catch release which will be more fully explained. To support the end of barrel 60 opposite the end mounted to thickened wall 70 there is provided support post 76 spanning the side walls of housing 22 and secured in this embodiment by cotter 78, one of which is shown in FIG. 1. In this respect, and referring now to FIGS. 2 and 3, stop member 32 includes sides 80 and 82 each of which are provided with an arcuate slot 84 which is positioned relative to support post 76 such that as stop member 34 moves between the raised and retracted positions, arcuate slots 84 provide clearance for support posts 76.

As shown in FIG. 3 of the drawings, stop member 34 preferably includes reinforcement portion 88 which has a camming face 90 and a latch rod engagement projection 92 such that a ledge or step 94 is formed. Camming face 90 is beveled at an angle corresponding to beveled camming rod end 96 so that the two form mating camming surfaces. As will be seen, the movement of stop member 34 from the projective or raised position to the lowered or retracted position causes rod end 96 to cam along camming face 90 of reinforcement 88 such that plunger 66 is forced to move deeper within barrel 60. This movement is against the biasing force of helical spring 97 which is compressed within barrel 60 between screw 72 and spring engaging end 98 of plunger 66. The strength or biasing force of helical spring 97 as well as springs 52 and 53 is dictated by the desired ease of operation. They should, however, be strong enough to provide good action by the parts which they bias consistent with the objective of the present invention.

Referring now to FIGS. 2 and 4, pivotable latch rod catch 102 is provided which pivots on pivot pin or axle 104 with respect to barrel 60 and latch rod or plunger 66. Pivot pin 104 is preferably rigidly attached to leg 106 and leg 108 of catch 102 with pin or axle 104 in substantially free rotation association with respect to barrel 60 and plunger 66 as will be more fully described. Each leg, 106, 108 is provided with pin engagement surfaces 110 and pin retaining notches 112, and cross member 114 is provided to provide added strength to catch 102 and for providing a space to create hole 116 shown in FIG. 6.

As can be seen in FIGS. 3 through 5, catch 102 pivots between a first position in which pin engagement surfaces 110 ride on latch rod pins 68 and a second position in which latch rod pins 68 are retained within pin retaining notches 112. Pin engagement surfaces 110 are in the nature of camming surfaces such that the movement of pin 68 as plunger 66 is forced deeper into barrel 60 causes pin engagement surfaces 110 to ride upon on pin 68 as shown best in FIG. 3. Therefore, pin engagement surfaces 110 should be slightly rounded for this purpose.

As shown in FIGS. 3 through 5, hook 118 is provided, extending through hole 116 and attached to spring 120. The other end of spring 120 is similarly equipped with a hook 122 which is connected to hook projection 124 on housing 22 via hole 126. Spring 120 serves to bias catch 102 until catch 102 engages pins 68 in retaining notches 112 as plunger 66 moves deeper into barrel 60.

Referring now to FIG. 7, the relative position of helical spring 97 and spring engaging end 98 of rod 66 are shown. Also seen is the beveled nature of end 128 of barrel 60 which provides good clearance with top wall 129 of stop member 34 during operation as shown in FIG. 4. As seen in FIG. 7, not only are slots 64 provided in barrel 60 which provide clearance for pins 68 during the movement of plunger 66, plunger 66 is provided with a slot or channel 130 for clearance with catch pivot pin 104. In other words, channel 130 allows plunger 66 to move freely without being impeded by catch pivot pin 104. Again, it is preferred that all of the components be made of metal or another hard, durable material, possibly some plastics, to provide strength and durability. In particular, reinforcement 88 of stop member 34 should be sufficiently thick to provide good structural reinforcement.

In operation, and referring now to FIG. 1 of the drawings, as door 26 is opened from door frame 132 with stop member 34 in the retracted position, door 26 freely moves through its arc of passage and across door security device 20 in an unrestricted fashion. In this retracted mode, and as best seen in FIG. 3 of the drawings, stop member 34 is held within housing 22 against the bias of springs 50 and 51 by the interaction of end 96 of plunger 66 on ledge 94 of projection 92. Plunger 66 is biased against camming surface 90 such that end 96 engages ledge 94 by virtue of the force of helical spring 97. Plunger 66 is allowed this freedom because catch 102 in this mode of operation does not retain plunger 66 within barrel 60; rather, pin engagement surfaces 110 of catch 102 ride on pins 68 as shown.

In order to raise stop member 34 to the projective position shown in phantom in FIGS. 1 and 5, a vertical or downward force is applied to principal surface 36 of stop member 34 to move stop member 34 down within housing 22 as shown in FIG. 4. As this downward movement occurs, the camming action of camming surface 90 on plunger end 96 forces plunger 66 to move rearwardly, deeper into barrel 60. Pins 68 on which pin engagement surfaces 110 were riding in FIG. 3, now move backward where they are captured in retaining notches 112 due to the configuration of notches 112 and the biasing force of spring 120 on catch 102. That is, once pins 68 reach a certain position on pin engagement surfaces 110, the biasing force of spring 120 on catch 102 causes catch 102 to pivot forward by virtue of pivot pin 104 to the position shown in FIG. 5. Plunger 66 is thus retained in barrel 60 with sufficient clearance between end 96 and ledge 94 such that springs 50 and 51 are now free to spring stop member 22 into the raised or projective position shown in FIGS. 1 and 5. In this position, as door 26 begins to move through its arc of passage, door 26 encounters door engaging surface 38 of stop member 34, whereby the movement of door 26 is successfully impeded. Due the strength of door security device 20, it is virtually impossible to open door 26 without completely destroying the door.

As stop member 34 rises into the raised or projective position out of housing 22 as shown in FIG. 5, stop member 34 pivots on pivot axle 54. This pivoting motion of stop member 34 causes catch release bar 74 to move toward catch 102. In FIG. 5, catch release bar 74 is shown in an intermediate position during the pivoting of stop member 34 in contact with legs 106 and 108. It is important that the biasing force of springs 50 and 51 be sufficient to counteract the biasing force of spring 120 such that stop member 34 can raise completely while simultaneously rotating catch 102 in the direction of arrow B on pivot pin 104. In other words, as stop member 34 moves into the raised position, catch release rod 74 strikes catch 102 below pivot pin 104, causing catch 102 to release pins 68 from pin retaining notches 112. Thus, pin retaining notches 112 are shaped to allow them to easily release pins 68 during this action. As pin retaining notches 112 release pins 68, plunger 66 is ejected in response to the biasing force of spring 97 into its extended position. It will now be understood that as stop member 34 rises, latch mechanism 58 is reset and is then prepared to retain stop member 34 when it is lowered by one's foot to its flush position.

When plunger 66 is in its extended position, end 96 extends a preselected, limited distance from barrel 60. This is achieved by preselecting the length L of plunger 66 as well as length L1 as shown in FIG. 7. Length L is the distance of that portion of plunger 66 from end 96 to pins 68. Length L1 is the distance of that portion of barrel 66 from end 128 to the beginning of slots 64. The distance which plunger 66 extends from barrel 60 when not restrained by catch 102 is limited by pins 68 which are restricted in slots 64. That is, as pins 68 move toward barrel 128, they reach the end of slots 64 where they stop. This configuration is shown best in FIG. 7. It is thus important that the relative length of extended plunger 66 be such that it does not extend beyond face 93, so that as stop member 34 moves downwardly, face 93 contacts end 96 of plunger 66, urging plunger 66 backward into barrel 60 into a partially retracted position until end 96 passes ledge 94 whereupon plunger 66 then clicks forward into the stop member retaining position shown in FIG. 3. Thus, face 93 and end 96 engage in the manner of a camming action.

A closure plate can be provided if desired as shown in FIG. 4 which is simply a plate 134 having four legs 136. Legs 136 can be received in slots 138 in floor plate 30 and cover plate 42. The purpose of plate 134, which is wholely optional is merely to prevent the unlikely inadvertent raising of stop member 34, including by children or the like when its use is not desired. Plate 136 could be equipped with a lock if desired. It will also be understood that the present invention can be used simply as a door stop rather than a security device. As a security device, it should be placed within inches from a door such that the door can be opened only fractionally when security device 20 is in the raised position, thus preventing an intruder from reaching through the door opening to lower the device. It will be appreciated that stop member 34 cannot be lowered while engaging door surface 39, since stop member 34 moves forward slightly during its pivoting path into the lowered position. Thus, door 26 must be moved toward its closed position somewhat to close door 26. Also, a spacer (not shown) can be provided between door surface 39 and door engaging surface 38 of stop member 34 such that door security device 20 can be used to secure a door 26 in its normal closed position. Alternatively, security device 20 can be used simply to hold a door open as desired. Many other applications will be known to those skilled in the art, one of which may include use in sliding doors with track mechanisms, for example, patio doors. In this use, corresponding grooves can be provided in cover plates 42 and 44. It may also be possible to automate door device 20 such that it can be operated remotely. For example, a solenoid could be included in latch mechanism 58 so that stop member 34 can be activated from a remote position such as outside door 26.

While a particular embodiment of this invention is shown and described herein, it will be understood of course, that the invention is not to be limited thereto since many modifications may be made, particularly by those skilled in the art, in light of this disclosure. It is contemplated therefore by the appended claims to cover any such modifications as fall within the true spirit and scope of this invention.

What is claimed is:

1. A door stop comprising:

a stop member having a door-engaging surface and a camming surface;

a housing having an opening to closely receive said stop member;

a latching mechanism having a barrel and a spring-biased plunger within said barrel;

said latching mechanism further including a catch for retaining said plunger in a retracted position within said barrel;

said plunger having an end for engaging said camming surface of said stop member;

means for biasing said stop member in a first position in which at least a portion of said stop member projects out of said housing through said opening; and means responsive to pressure exerted on said stop member for pivoting said stop member between said first position and a second position, said stop member being substantially within said housing in said second position.

2. The door stop recited in claim 1, further including a floor plate attached to said housing to be mounted on a floor surface.

3. The door stop of claim 1, wherein said end of said plunger is beveled.

4. The door stop recited in claim 1, wherein one end of said barrel is attached to said housing and the other end of said barrel is beveled.

5. The door stop recited in claim 1, wherein said means for biasing said stop member in said first position includes a spring.

6. The door stop recited in claim 1, wherein said catch is a pivotable catch which is spring biased.

7. The door stop recited in claim 1, wherein said foot-actuated door stop is constructed of a material selected from the group consisting of metal and hard plastic.

8. The door stop recited in claim 1, wherein said stop member includes a projection defining a ledge.

9. A foot-operated door security device having a stop member to be mounted flush with a flat surface such as a floor for allowing the passage of a door when said door security stop member is in a retracted first position and to engage a surface of said door restricting its passage when said door security stop member is in a projected second position, said door security device comprising:

a pivotable stop member having a door engaging surface and a principal surface;

a housing having an opening for closely receiving said stop member;

a barrel having a dual-sloted wall, said barrel being mounted within said housing;

a first spring positioned within said barrel;

a latch rod partially and closely received in said barrel and biased by said first spring;

mating camming surfaces on said latch and said stop member;

a pivotable catch for retaining said latch rod within said barrel in one operational mode;

a second spring attached at one end to said pivotable catch and at the other end to said housing for biasing said catch;

a catch release bar attached to said stop member for intermittently engaging said catch;

opposed pins attached to said latch rod for engagement by said pivotable catch, said pins extending through the slots of said dual-slotted wall;

an axle supporting said stop member as said stop member pivots between a retracted position and a projective position;

a third spring for biasing said stop member in said projective position;

a ledge contiguous with said camming surface of said stop member and forming a portion of said stop member for engaging said latch rod to restrain said stop member in said retracted position against the bias of said third spring;

means for mounting said door security device in a substantially flat surface such that said principal surface is substantially coplanar with said flat surface when said stop member is in said retracted position, whereas a first pressure applied substantially perpendicular to said principal surface of said stop member when said stop member is in said retracted position causes said mating camming surfaces of said latch rod and said stop member to interact forcing said latch rod to move against the biasing force of said first spring in said barrel whereby said pin attached to said latch rod moves along said slots of said barrel to a position where said pivotable catch engages and restrains said pins thereby restraining said latch rod in said barrel such that said stop member is free to move under the biasing force of said third spring into said projective position at which time said door engaging surface of said stop member engages a surface of a door rigidly preventing the movement of said door past said door security device, whereby said movement of said stop member into said projective position causes said catch release bar to engage said catch that said pivotable catch pivots, releasing said opposed pins of said latch rod resetting said latch rod and whereby a second pressure applied substantially perpendicular to said stop member when said stop member is in said projective position moves said stop member into said retracted position causing said latch rod to engage said ledge to restrain said stop member in said retracted position against the biasing force of said third spring so that said door is free to pass over said retracted stop member.

10. The foot-operated door security device recited in claim 9, wherein said door security device is constructed of a material selected from the group consisting of metal and hard plastic.

11. The foot-operated door security device recited in claim 9, further including a mounting plate attached to said housing be mounted to said flat surface.

12. The foot-operated door security device recited in claim 11, wherein said mounting plate has at least one slot and further including a closure plate having at least one leg to be closely received within said slot, said closure plate being provided to prevent inadvertent triggering of said foot-operated door security device when not contemplating use.

13. The foot-operated door security device recited in claim 9, wherein said door engaging surface of said stop member is covered with a resilient pad.

14. The foot-operated door security device recited in claim 9, wherein one end of said barrel is beveled for clearance with said stop member.

* * * * *